US008422719B2

(12) United States Patent
Dedieu et al.

(10) Patent No.: US 8,422,719 B2
(45) Date of Patent: Apr. 16, 2013

(54) MINIATURIZED RECEIVER ASSEMBLY FOR IN-EAR NOISE-ISOLATING EARPHONES

(75) Inventors: Stéphane Dedieu, Ottawa (CA); Ian McIntosh, Alexandria (CA)

(73) Assignee: Sonomax Technologies Inc., Montreal, Quebec (CA)

( * ) Notice: Subject to any disclaimer, the term of this patent is extended or adjusted under 35 U.S.C. 154(b) by 136 days.

(21) Appl. No.: 12/923,695

(22) Filed: Oct. 5, 2010

(65) Prior Publication Data

US 2011/0081035 A1 Apr. 7, 2011

Related U.S. Application Data

(60) Provisional application No. 61/272,532, filed on Oct. 5, 2009.

(51) Int. Cl.
*H04R 25/00* (2006.01)

(52) U.S. Cl.
USPC ..... 381/380; 381/328; 381/322

(58) Field of Classification Search ..... 381/322, 381/324, 325, 328, 71.6, 72, 345, 349, 371, 381/372, 373, 380, 382; 181/129, 130, 135; 128/864, 867
See application file for complete search history.

(56) References Cited

U.S. PATENT DOCUMENTS

| | | | | | |
|---|---|---|---|---|---|
| 4,239,945 | A | * | 12/1980 | Atoji et al. | 381/371 |
| 4,867,267 | A | * | 9/1989 | Carlson | 181/130 |
| 5,832,094 | A | * | 11/1998 | Le Her | 381/328 |
| 6,339,648 | B1 | | 1/2002 | McIntosh et al. | |
| 6,754,357 | B2 | | 6/2004 | McIntosh et al. | |
| 2005/0123146 | A1 | | 6/2005 | Voix et al. | |

* cited by examiner

*Primary Examiner* — Huyen D Le
(74) *Attorney, Agent, or Firm* — Equinox Protection; Franz Bonsang

(57) ABSTRACT

An in-ear device comprises inter alia a miniaturized receiver assembly of a sealed sandwich construction with a front plate and a back plate and an electro-dynamic receiver therebetween, the assembly providing a bass-reflex design with a front resonator.

11 Claims, 1 Drawing Sheet

MINIATURIZED RECEIVER ASSEMBLY FOR IN-EAR NOISE-ISOLATING EARPHONES

CROSS REFERENCE TO RELATED APPLICATIONS

Benefit of U.S. Provisional Application for Patent Ser. No. 61/272,532 filed on Oct. 5, 2009, being incorporated herein by reference, is hereby claimed.

FIELD OF THE INVENTION

This invention relates to an in-ear device and in particular concerns the use of miniaturized receivers with enhanced sound reproduction properties.

BACKGROUND OF THE INVENTION

In-ear devices are of course well known, but with the advent of miniaturisation of components and the deployment of miniaturized technology in this field, there have been significant advances in making such ear devices more acceptable in use and in large measure invisible to the eye. In particular, the advent of and meteoric rise in the cell phone industry have motivated the development of miniature receivers and speakers to the extent that the use of cell phones has become widespread across the globe, with relevant industries making daily technological advances.

However, there remains a need for further improvement in terms of enhancing the audio performance of the in-ear device by optimizing the frequency response of the receiver.

Accordingly, there is a need for an improved in-ear noise-isolating earphone with miniaturized receiver (microphone or receiver).

SUMMARY OF THE INVENTION

A general object of the present invention is thus to provide an improved in-ear noise-isolating earphone with miniaturized receiver.

An advantage of the present invention is that an in-ear noise-isolating earphone is provided with an acoustical loudspeaker system (later referred to as "receiver") therefor.

Another advantage of the present invention is that the in-ear earphone with receiver assembly has enhanced frequency response performance, which can even be tuned according to the preference of the user.

A further advantage of the present invention is that the receiver assembly, although made with an elongated receiver, can be axially inserted into an in-ear earphone without significantly compromising the overall performance thereof.

According to one aspect of the present invention there is provided an in-ear earphone device comprising an ear piece for insertion within an ear canal, a sound bore defined within the ear piece, a miniaturized receiver assembly disposed within the sound bore and having a bass reflex system.

The bass reflex system is also known as an acoustical Helmholtz resonator tuned to extend the low frequency response of the loudspeaker.

The ear-piece may be morphologically formed in many different ways, including the methods in accordance with the inventions disclosed in U.S. Pat. No. 6,687,377 and in US patent application No. 2008-0123146A1.

The miniaturized receiver assembly is duly inserted into and held within the sound bore substantially axially thereof.

According to another aspect of the invention there is provided a miniaturized receiver assembly suitable for insertion within a sound bore of an in-ear device and having a miniaturized bass reflex system, the receiver assembly being of elongate form and comprising in combination a front plate having a channel formed therein and extending partially along its length, a back plate provided with a vent port, a receiver sealed between the front plate and the back plate, the sound channel of the front plate facing the receiver.

Conveniently, the assembly further includes a resonator.

The front and back plates may be so dimensioned as to form the said resonator adjacent the receiver, the latter being in the form of the loudspeaker model No. RA4810 sold by NXP Semiconductors Netherlands B.V. of The Netherlands or the like.

The front and back plates may be generally rectangular and of elongate form with the receiver being of corresponding shape and form.

The front and back plates extend at one end thereof beyond the receiver to constitute the front resonator as aforesaid. In this connection, it will be appreciated that the resonator may be disposed distal from the receiver per se when in situ within the sound bore.

The front plate, the receiver incorporating a speaker and the back plate are suitably assembled in sandwich form in a manner well known in the art.

Other objects and advantages of the present invention will become apparent from a careful reading of the following description.

BRIEF DESCRIPTION OF THE DRAWINGS

Further aspects and advantages of the present invention will become better understood with reference to the description in association with the following figures, in which similar references used in different figures denote similar components, wherein.

DETAILED DESCRIPTION OF THE PREFERRED EMBODIMENTS

Figure 2:
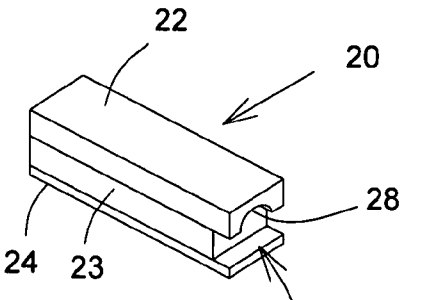
FIG. 2 is an isometric schematic view of the miniaturized receiver assembly of FIG. 1.

Referring to the drawings, there is illustrated at 1 an in-ear device about to be inserted into an ear canal 2 of a human ear 4 also showing the cavum concha at 6.

The in-ear device 1 comprises an ear piece 8 including a nipple 10 which preferably fits morphologically within the ear canal 2, the nipple 10 extending to a platform or head 12 in use seated within the cavum concha 6. The head 12 is of enlarged dimension in comparison to the nipple 10 and is provided with a capping 14.

The head 12 and the nipple 10 are formed with a through sound bore 16 for transmitting sound into the human ear 4.

Figure 3:
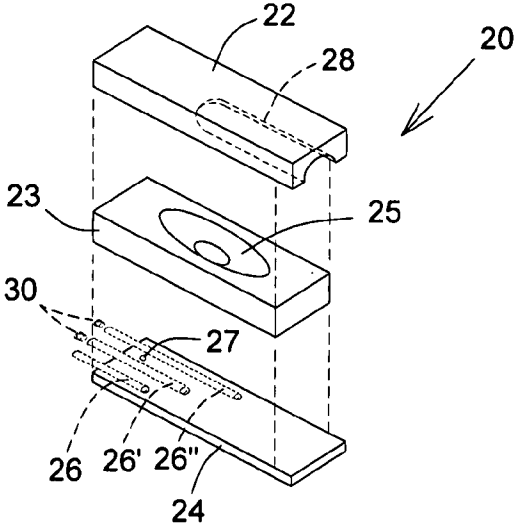
FIG. 3 is an exploded view of the miniaturized receiver assembly shown in FIG. 2.

Referring now more particularly to FIGS. 2 and 3, a miniaturized receiver assembly of generally elongate form is shown by the reference numeral 20 and comprises a front plate 22 and a back plate 24 with an electro-dynamic receiver 23 sandwiched therebetween, the receiver having a diaphragm 25 (note that the receiver could alternatively be efectro-static or evert piezzo-electric or the like). The front and back plates 22, 24 and the receiver 23 are generally rectangular shape. The diaphragm 25 although shown as being oval may alternatively be rectangular, as will be understood by one skilled in the art. The sealed sandwich assembly is beneficial in that it minimizes the acoustical volume seen by the electro-dynamic receiver.

The front plate 22 is provided with a sound channel 28 extending partially along the length thereof from the diaphragm 25 to open into one end of the plate into the sound bore 16 as can be seen. The back plate 24 is typically provided with a control tubing 26 (shown in dotted lines in FIGS. 1 and 3, and typically reaching the ambient pressure) and/or a vent port 27 for the purpose of venting the back plate to provide a bass reflex feature to optimize the low frequency response of the electro-dynamic receiver 23. In order to allow for fine tuning of the low frequency response of the receiver assembly 20, the back plate 24 is optionally provided with a plurality of control tubing 26, 26', 26", of different lengths and/or bores (cross-sections) with only one of them being opened at a time, the non-selected ones being closed using appropriate plugs 30 or the like (although only one vent port is illustrated, a plurality of vent ports 27 of different sizes located at different locations on the back plate 24 could also be considered for the same tuning purpose). Although not shown, the plugs 30 could be replaced by a plate closing the unused tubings and having an opening made in line with the selected tubing. The front plate 22, the back plate 24 and the sound channel 28 are configured in such a way to extend beyond the length of the receiver 23 at one end thereof to form an expansion chamber or front resonator 29.

Figure 1:
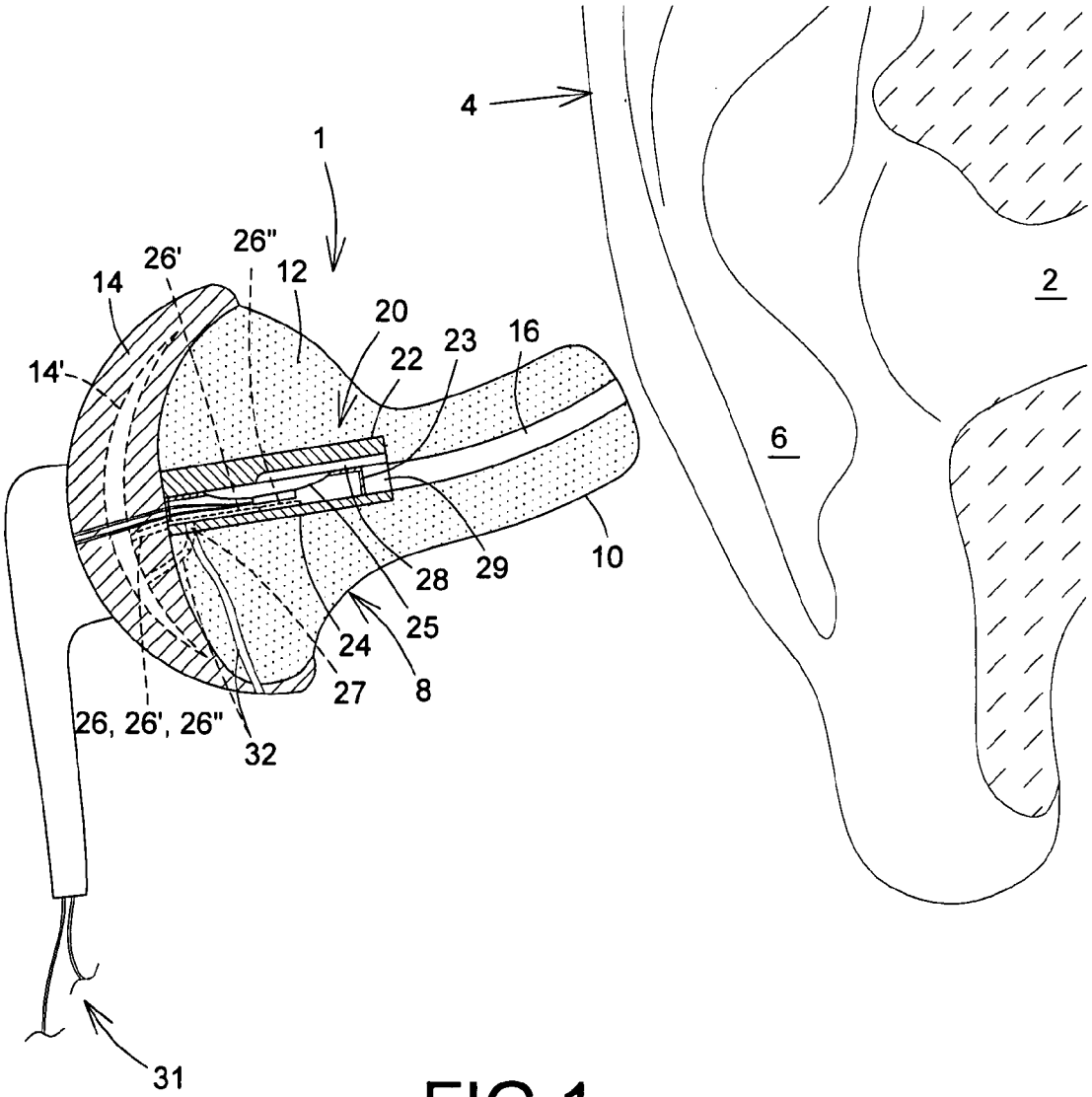
FIG. 1 is a diagrammatic illustration of a human ear showing an in-ear noise-isolating earphone with a miniaturized receiver assembly in accordance with an embodiment of the present invention about to be inserted into the ear canal of the ear.

The miniaturized receiver assembly 20 is inserted substantially axially into the sound bore 16 as seen in FIG. 1, meaning that it could be adjacent thereto and in communication therewith, with appropriate wiring 31 passing through the capping 14 to connect with the miniaturized receiver assembly 20. It will be seen that a vent canal 32 is provided in the head 12 and connects with the vent port 27 (vent port may extend into internal cavity 14' either inside the capping 14 as shown in dotted lines in FIG. 1 or between the capping and the head 12 or through outer capping to atmosphere depending on desired low frequency response. It will be understood that the resonator 29 may be located at any point downstream of the receiver between the latter and the distal end of the sound bore 16 within the ear canal 2, or even be, at least partially, formed by the sound channel 28.

It will be appreciated that whilst the miniaturized receiver assembly 20 is illustrated as being disposed in the sound bore 16 at its proximal end nearest the head 12, it may equally be inserted further into the bore and indeed the deeper into the bore it is located the better the frequency response will be of the electro-dynamic receiver.

The provision of a vent port allows a bass reflex design to optimize as indicated supra the frequency response of the receiver 23.

The miniaturized receiver may be of the kind employed in cell phone technology and thus widely available.

Although the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

We claim:

1. A miniaturized receiver assembly suitable for insertion within the sound bore of an in-ear device and having a miniaturized bass reflex system, the receiver assembly being of elongate form and comprising in combination a front plate having a sound channel formed therein and extending partially along its length, a back plate provided with a vent port, and an electro-dynamic receiver sealed between the front plate and the back plate, the sound channel of the front plate facing the receiver.

2. An assembly according to claim 1, wherein the front plate, the back plate and the channel are configured in such manner as to extend beyond the length of the receiver at one end thereof to form a resonator.

3. An assembly according to claim 2, wherein the receiver includes a diaphragm sandwiched between the front plate and the back plate.

4. An assembly according to claim 1, wherein the vent port comprises at least one control tubing extending along the length of the back plate and in communication with the receiver.

5. An assembly according to claim 4, wherein there is provided a plurality of control tubings of different dimensions.

6. An assembly according to claim 5, wherein said plurality of control tubings are of differing lengths.

7. An assembly according to claim 6, wherein said plurality of control tubings are of differing bore sizes.

8. An assembly according to claim 4, wherein a plug is provided for each of said at least one control tubing, the plug(s) in use being adapted to be selectively applied to seal a respective end of a control tubing thereby to tune the frequency response in accordance with the individual requirement of a user of the assembly.

9. An in-ear device comprising an ear piece for insertion within an ear canal, a sound bore defined within the ear piece, and an elongate miniaturized receiver assembly according to claim 1 substantially axially disposed within the sound bore and having a bass reflex system.

10. An in-ear device according to claim 9, wherein the ear piece is morphologically formed.

11. An in-ear device according to claim 9, wherein the miniaturized receiver assembly is inserted into and held within the sound bore substantially axially thereof.

* * * * *